United States Patent [19]

Djordjevic

[11] Patent Number: 4,644,924

[45] Date of Patent: Feb. 24, 1987

[54] FUEL INJECTION PUMP WITH SPILL CONTROL MECHANISM

[75] Inventor: Ilija Djordjevic, Windsor, Conn.

[73] Assignee: Stanadyne, Inc., Windsor, Conn.

[21] Appl. No.: 779,201

[22] Filed: Sep. 23, 1985

Related U.S. Application Data

[63] Continuation-in-part of Ser. No. 658,887, Oct. 9, 1984, Pat. No. 4,552,117.

[51] Int. Cl.[4] ..... F02M 37/04

[52] U.S. Cl. ..... 123/506; 123/450; 417/462

[58] Field of Search ..... 123/450, 458, 459, 506; 417/294, 462

[56] References Cited

U.S. PATENT DOCUMENTS 3,759,239 9/1973 Regneault et al. ..... 123/506

3,857,374 12/1974 Glikin et al. ..... 123/506 X 4,200,072 4/1980 Bailey ..... 123/501 X 4,376,432 3/1983 Davis ..... 123/501 X 4,552,117 11/1985 Djordjevic ..... 123/506

*Primary Examiner*—Tony M. Argenbright

*Attorney, Agent, or Firm*—Prutzman, Kalb, Chilton & Alix

[57] ABSTRACT

A rotary fuel injection pump with a rotor having pumping plungers reciprocated for supplying high pressure charges of fuel for fuel injection and a spill control mechanism having one or two rotary spill valves mounted on the rotor and rotated in unison with the rotor and in synchronism with the reciprocable movement of the pumping plungers for spill control of the high pressure charges of fuel. The spill timing is adjustable by the spill control mechanism at the beginning and/or end of the fuel injection event.

16 Claims, 29 Drawing Figures

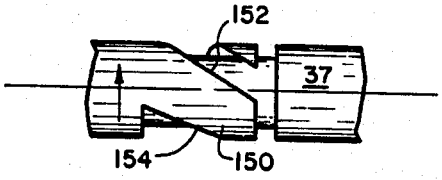
FIG. 5
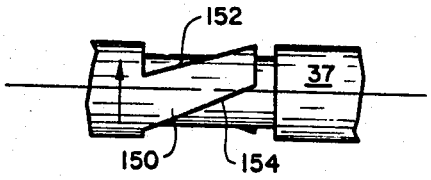
FIG. 6
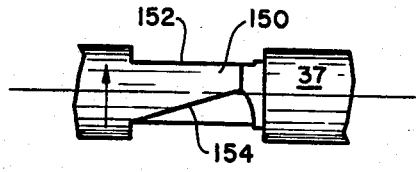
FIG. 7
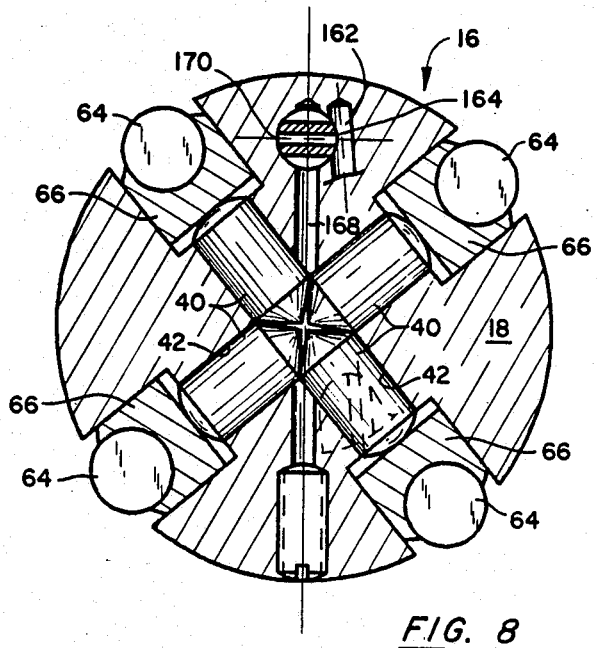
FIG. 8
FIG. 9
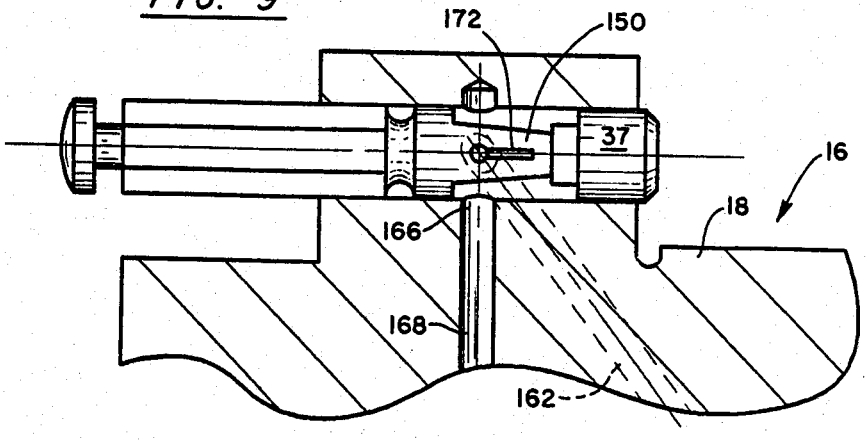

FUEL INJECTION PUMP WITH SPILL CONTROL MECHANISM

RELATED APPLICATION

The present application is a continuation-in-part of copending application Ser. No. 658,887, filed Oct. 9, 1984, now U.S. Pat. No. 4,552,117, and entitled "Fuel Injection Pump With Spill Control Mechanism".

DESCRIPTION

Background And Summary Of The Invention

The present invention relates generally to fuel injection pumps of the type having a rotary charge pump with one or more reciprocating pumping plungers for sequentially supplying measured charges of fuel under high pressure to an associated internal combustion engine for fuel injection and relates more particularly to a new and improved spill control mechanism for spill control of the high pressure fuel charges.

In a fuel injection pump of the type described, it may be desirable to control the size and/or timing of each high pressure fuel charge by a spill control system providing spill control of the beginning and/or end of the high pressure fuel injection event. For example, U.S. Pat. No. 4,376,432 of Charles W. Davis, dated Mar. 15, 1983, discloses a spill control system providing spill control of the end of the fuel injection event.

In accordance with the present invention, several embodiments of a spill control mechanism are provided which employ one or more rotating fuel control valves for spill control of the high pressure fuel charges. Each rotating fuel control valve is mounted on the charge pump rotor and connected to the charge pump for spill control of the high pressure fuel charges. The high pressure fuel charges are precisely controlled with a high degree of repeatability and reliability over a long service free life.

A principal object of the present invention is to provide a new and improved spill control mechanism of the type operable for controlling the size and/or timing of the high pressure fuel charge by spill control of the beginning and/or end of the fuel injection event. In accordance with the present invention, the spill control mechanism is compact, is useful in rotary fuel injection pumps of the type described without substantial pump modification, can be economically manufactured and provides accurate spill control for repeatable delivery of precise high pressure fuel charges.

Another object of the present invention is to provide a new and improved spill control mechanism of the type described which provides precise control of the size and injection rate of the injected fuel charges.

Another object of the present invention is to provide a new and improved spill control mechanism of the type described which permits controlling the injection rate of the injected fuel charges, for example for reducing the combustion noise at engine idle and during engine cranking.

Another object of the present invention is to provide a new and improved spill control mechanism of the type described for establishing a high pressure pilot fuel injection phase in advance of a main fuel injection phase.

Still another object of the present invention is to provide in a fuel injection pump of the type described, a new and improved spill control mechanism useful in fuel injection systems having very high fuel injection pressures of up to 12,000 psi or more.

A further object of the present invention is to provide a new and improved spill control mechanism of the type described having an operating mechanism for adjusting the size of the injected fuel charges in a precise and simple manner and for varying the fuel injection timing in accordance with a change in the engine load and/or engine speed.

Another object of the present invention is to provide a new and improved spill control mechanism of the type described for adjusting the spill timing at the beginning and/or end of the fuel injection event.

Another object of the present invention is to provide a new and improved spill control mechanism of the type described which can be readily adapted to be operated to control the size and/or timing of the high pressure fuel charges supplied by the pump, for example by mechanical, electrical, hydraulic and/or vacuum operated means driven by the fuel injection pump or the associated engine.

Other objects will be in part obvious and in part pointed out more in detail hereinafter.

BRIEF DESCRIPTION OF THE DRAWINGS

In the drawings:

FIGS. 4–7 are enlarged partial side views, partly broken away, of four embodiments of a fuel control valve member of the spill control mechanism;

FIG. 8 is an enlarged transverse section view, partly in section, of a modified rotor of the fuel pump;

FIG. 9 is an enlarged partial longitudinal section view, partly broken away and partly in section, of the modified rotor shown in FIG. 8;

DESCRIPTION OF THE PREFERRED EMBODIMENTS

Figure 1:
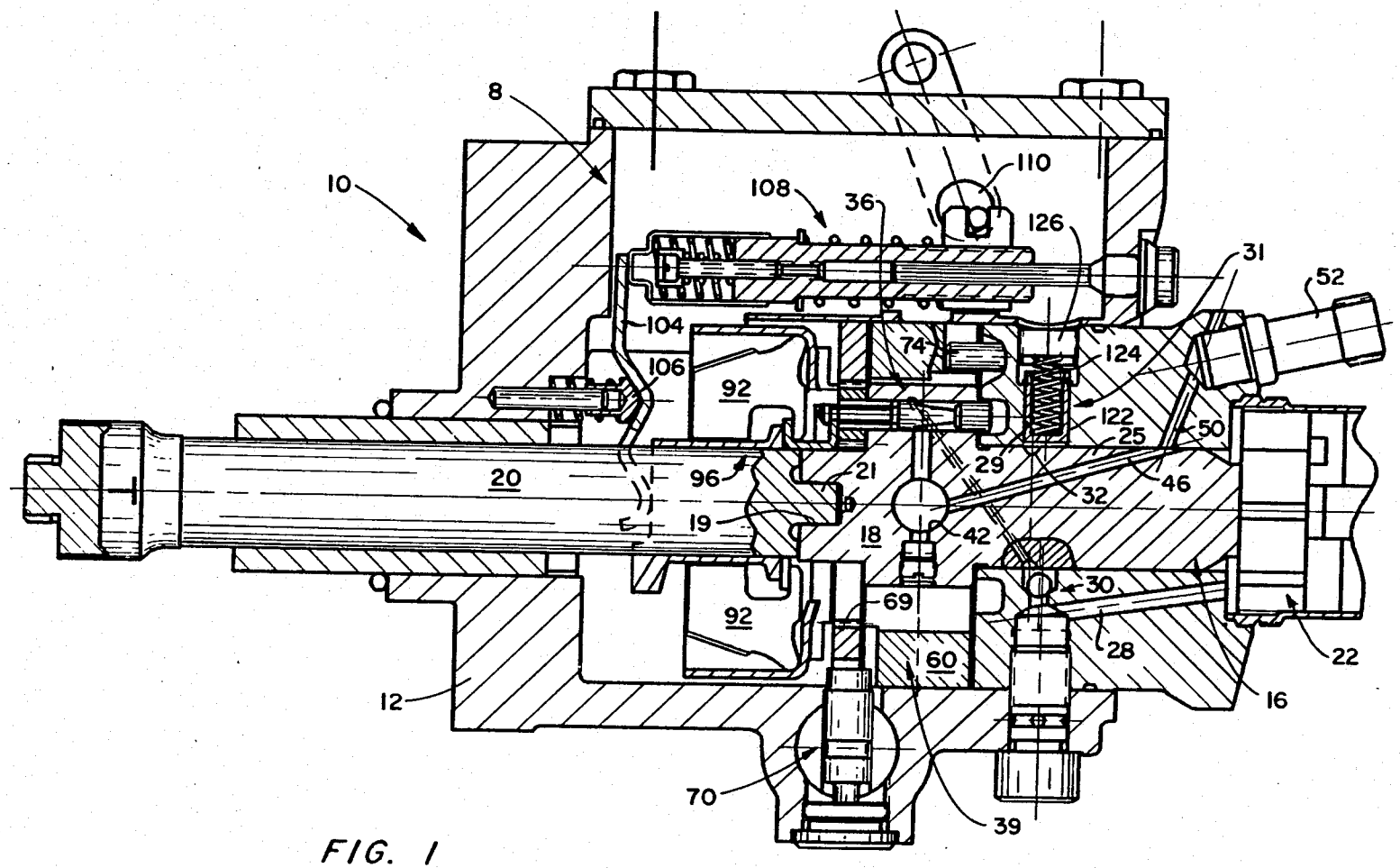
FIG. 1 is a longitudinal section view, partly broken away and partly in section, of a fuel injection pump incorporating a first embodiment of a spill control mechanism of the present invention.

Referring now to the drawings in detail wherein like numerals are used to designate the same or like functioning parts, several embodiments of a spill control mechanism 8 of the present invention are shown designed for incorporation in a fuel injection pump 10 which is otherwise of generally conventional construction. The fuel injection pump 10 is operable for sequentially supplying measured charges of fuel under high pressure to the fuel injection nozzles (not shown) of an internal combustion engine (not shown). The pump 10 has a housing 12 and a rotor 16 with a rotor body 18 and a coaxial rotor drive shaft 20 journaled in the housing 12. The drive shaft 20 is adapted to be driven by the engine (not shown) conventionally at one half engine speed and is coupled or keyed to the rotor body 18 by a diametral slot 19 at the inner end of the rotor body 18 and a diametral tang or key 21 at the inner end of the shaft 20.

Figure 2:
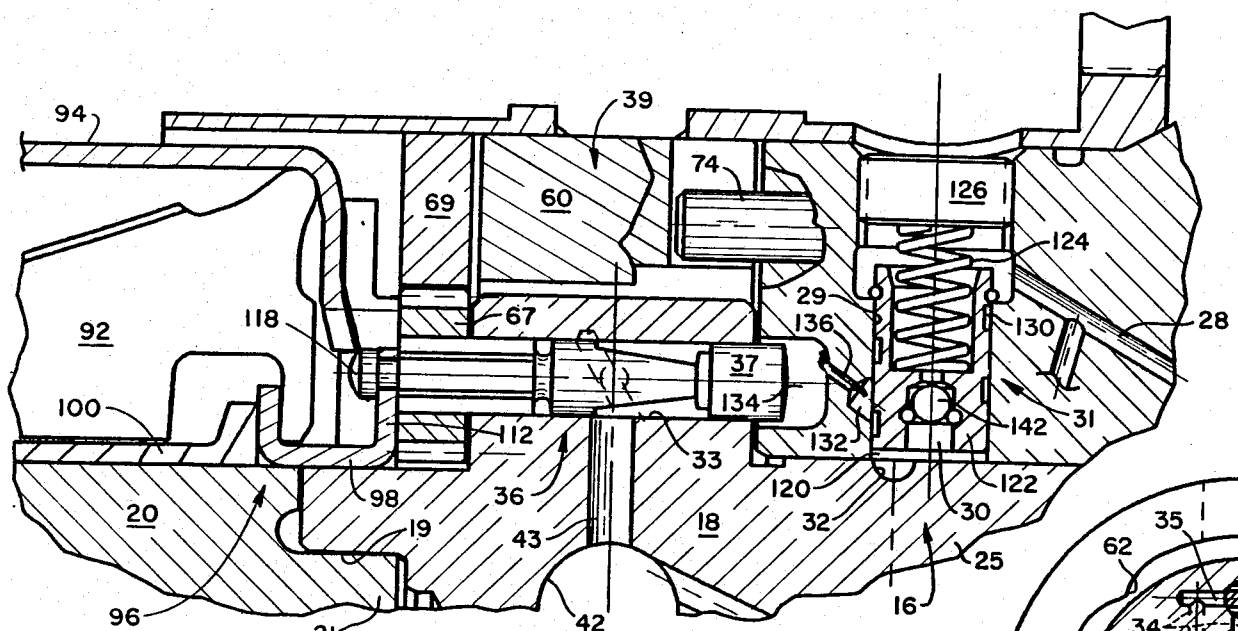
FIG. 2 is an enlarged partial longitudinal section view, partly broken away and partly in section, of the fuel pump, showing a modified accumulator system of the spill control mechanism.
Figure 3:
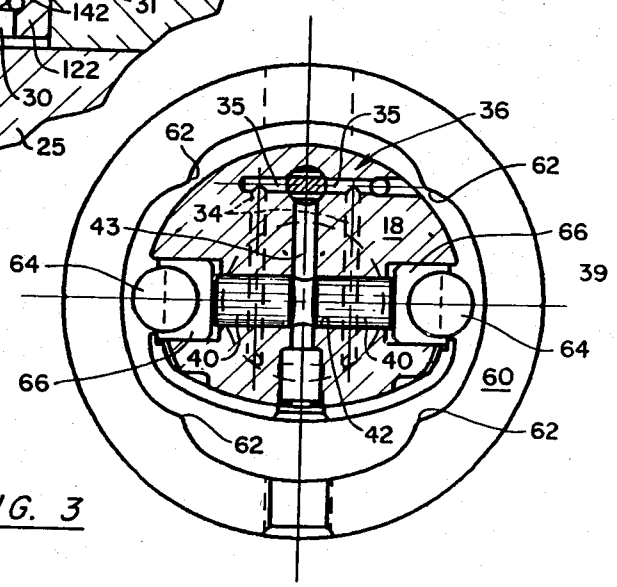
FIG. 3 is an enlarged partial transverse section view, partly in section, of the fuel pump.
Figure 4:
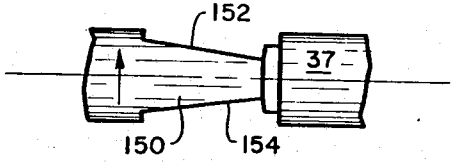
Figure 27:
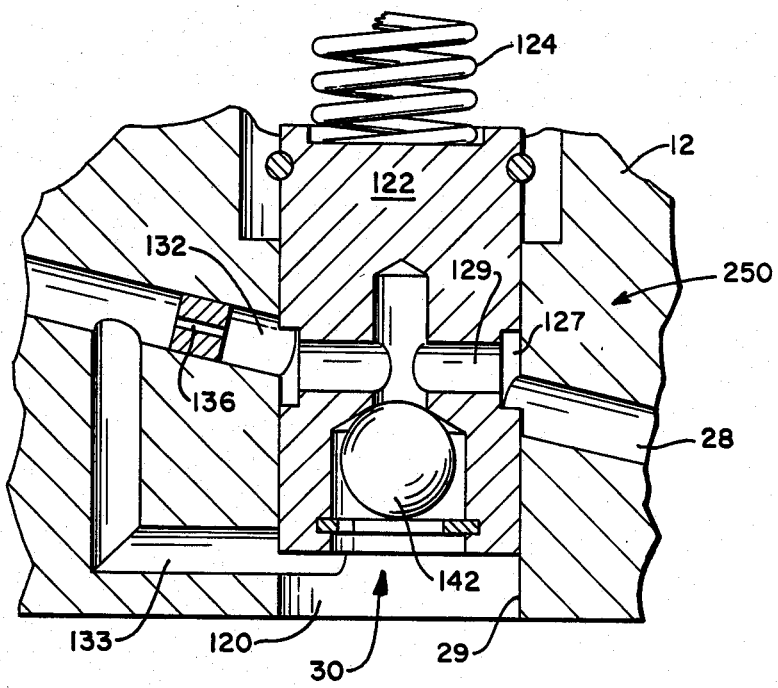
FIG. 27 is an enlarged partial longitudinal section view, partly broken away and partly in section, showing another modified accumulator system of the spill control mechanism.

A vane-type fuel transfer pump 22 is provided at the outer end of the rotor body 18 for being driven by the rotor 16. The transfer pump 22 receives fuel from a fuel tank (not shown) and is connected to supply fuel at a transfer pressure to an external annulus or groove 32 in a stem 25 of the rotor body 16 via an inclined axial passage 28 and via either a combined one-way ball check valve 30 and accumulator 31 or 250 mounted in a radial bore 29 in the housing 12 (as shown in FIG. 2 or 27) or via only a one-way check valve 30 (as shown in FIG. 1). A rotary fuel control valve 36 has a cylindrical valve bore 33 within the rotor body 18, and in the embodiment of FIGS. 1–3, the external groove 32 is connected to the valve bore 33 via a pair of separate internal passages 34 in the rotor body 18 which lead to a pair of diametrically opposed valve ports 35. The axis of the valve bore 33 is preferably parallel to and radially spaced from the axis of the rotor 16, and a rotary valve member 37 of the valve 36 is mounted for rotation within the valve bore 33. In the embodiment of FIGS. 1–3, the rotary valve member 37 is also mounted for axial displacement within the valve bore 33.

A suitable pressure regulator (not shown) is provided for regulating the output or transfer pressure of the transfer pump 22. In a conventional manner, the pressure regulator provides a speed correlated transfer pressure which increases with pump speed for operating certain hydraulically actuated mechanisms of the fuel pump. Also, the housing preferably has a suitable pressure relief valve (not shown) to maintain the fuel pressure within the housing cavity at a constant relatively low level of for example 10 psi and to return excess fuel to the fuel tank.

A high pressure rotary charge pump 39 shown in FIG. 3 has a pair of diametrically opposed coaxial pumping plungers 40 mounted for reciprocation within a diametral bore 42 in the rotor body 18. The charge pump 39 receives fuel from the transfer pum 22 via the fuel control valve 36 and via a radial bore 43 in the rotor body 18 which connects the valve bore 33 to the center of the pumping plunger bore 42.

A fuel charge at high pressure is delivered by the charge pump 39 via an inclined axial outlet bore or distributor passage 46 (FIG. 1) in the rotor body 18. The distributor passage 46 extends from the center of the pumping plunger bore 42 and registers sequentially with a plurality of housing outlet passages 50 (only one of which is shown in FIG. 1) equiangularly spaced around the periphery of the rotor 16. The outlet passages 50 are angularly spaced to provide sequential registration with the distributor passage 46 during the inward compression or delivery stroke of the plungers 40. A suitable delivery valve (not shown) is mounted downstream of each outlet passage fitting 52 to achieve a sharp cut-off of fuel to the respective fuel injection nozzle and to maintain a high residual pressure in the downstream fuel delivery line (not shown) leading to the nozzle.

An annular cam ring 60 having a plurality of equiangularly spaced pairs of diametrically opposed cam lobes 62 is provided for simultaneously actuating the charge pump plungers 40 inwardly for delivering high pressure charges of fuel for fuel injection as the rotor 16 rotates. A roller 64 and roller shoe 66 are mounted on the rotor body 18 in radial alignment with each plunger 40 for actuating the plunger inwardly.

A satellite gear 67 is mounted on the rotary valve member 37 for engagement with an internal ring drive gear 69 mounted on the left side of the annular cam ring 60 as viewed in FIGS. 1 and 2. The satellite gear 67 is keyed to the rotary valve member 37 by means of a hexagonal opening in the gear 67 and a conforming transverse hexagonal section of the valve member 37 which permits the valve member 37 to be axially shifted within the satellite gear 67. The ring drive gear 69 is angularly adjustable but does not rotate with the rotor 16 and such that the valve member 37 is rotated within its mounting bore 33 in unison with the rotor 16 and in synchronism with the reciprocable movement of the pumping plungers 40. The gear ratio provided by the valve and ring gears 67, 69 is selected to provide for example exactly three or four full revolutions of the valve member 37 within its mounting bore 33 for each full revolution of the rotor 16, depending on the number and therefore angular spacing of the distributor outlet passages 50 and thus the design of the associated engine. Although the axis of the rotary control valve 36 is preferably parallel to the rotor axis as shown, the valve axis may be at an acute angle to the rotor axis or perpendicular to the rotor axis, in which event the valve drive gearing would be modified accordingly.

Figure 20:
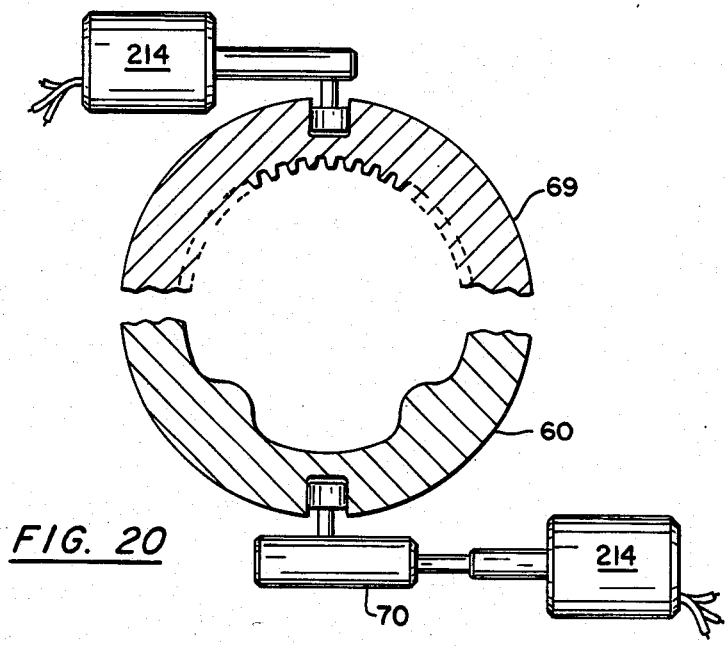

For adjusting the spill timing of the fuel injection event in correlation with engine speed, either (a) the coaxial cam ring 60 and ring gear 69 are angularly adjusted together by a suitable hydraulic timing actuator 70, or (b) only the annular drive gear 69 is angularly adjusted by a suitable timing actuator 70 as shown in FIG. 1, or (c) the annular cam ring 60 and drive gear 69 are independently angularly adjusted by separate actuators (for example by separate stepper motors 214 as shown in FIG. 20). In case (a) and (c) above, the timing actuator 70 for example may be like that shown in U.S. Pat. No. 3,331,327 of V. D. Roosa, dated July 18, 1967, or U.S. Pat. No. 4,476,837 of D. E. Salzgeber, dated Oct. 16, 1984. Also, in case (a) above, the drive gear 69 is connected by suitable drive pins to be angularly adjusted with the cam ring 60, or the gear ring 69 is mounted to be angularly adjusted with the cam ring 60 and also relative to the cam ring, for example as shown in FIG. 12.

Figure 11:
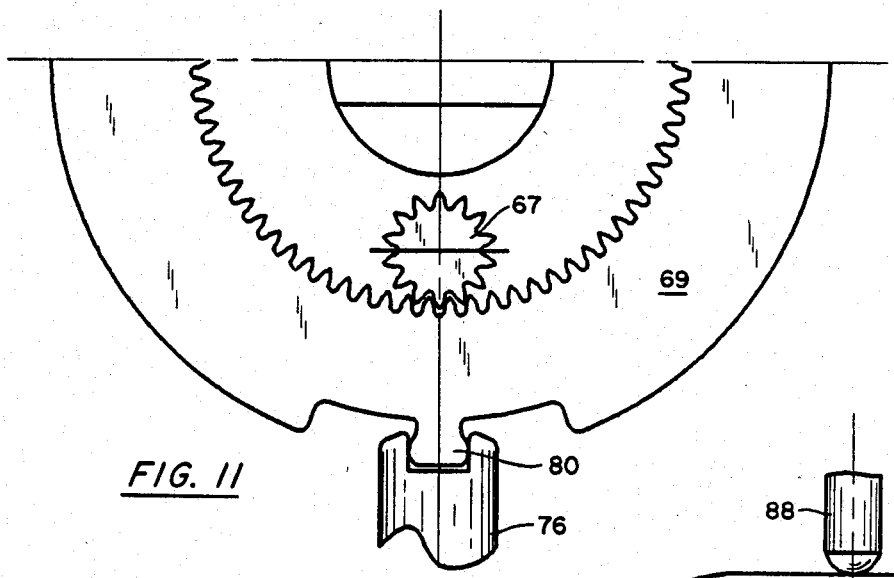
FIGS. 11, 12 and 20 are enlarged partial transverse section views, partly broken away, showing embodiments of an adjustment device of the spill control mechanism.

In case (b) above, an embodiment of which is shown in FIG. 1, the cam ring 60 is fixed to the housing 12 by suitable locating pins 74 and for example as shown in FIG. 11 the ring gear 69 is connected to be angularly adjusted by the timing actuator 70 via an upstanding transverse pin 76 of the actuator 70. For that purpose, the pin 76 has a slot receiving a cylindrical projection 80 of the gear ring 69. Thus, in the embodiment shown in FIG. 1, the angular reaction force on the cam ring 60 resulting from the inward actuation of the pumping plungers 40 is transmitted directly to the housing and the hydraulic actuator 70 may be economically designed to provide only the relatively light force required for angular adjustment of the ring gear 69. Also, to minimize the force required for rotating and axially shifting the valve member 37 and to reduce valve wear and improve valve operation, the valve member 37 is hydraulically balanced within its mounting bore 33. For that purpose, the two diametrically opposed valve ports 35 are provided for balancing the hydraulic side forces on the valve member 37.

Figure 12:
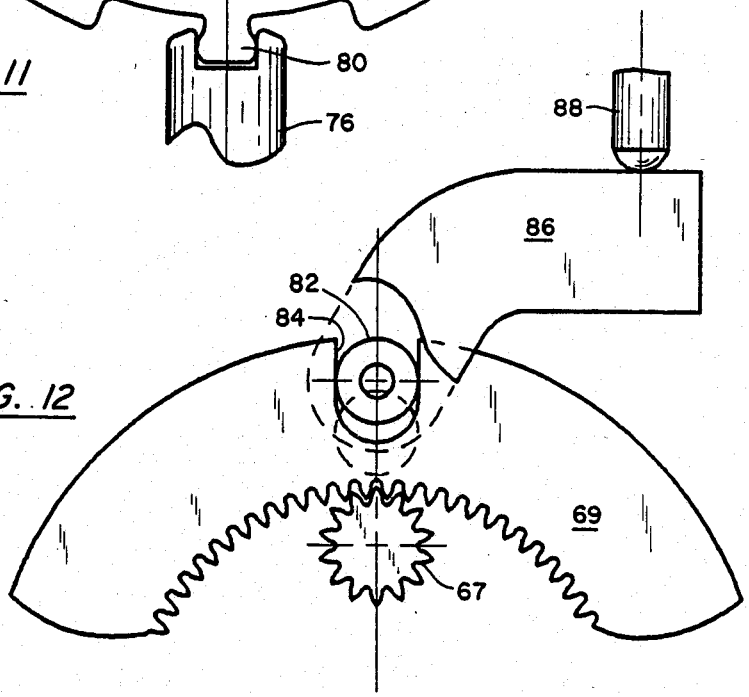

In the embodiment shown in FIG. 12, the ring gear 69 is mounted to be angularly adjusted relative to the cam ring 60 to provide a secondary control in addition to the primary control provided by the actuator 70. For that purpose, an eccentric cam 82 is mounted on the cam ring 60 for receipt within a radial slot 84 in the gear 69. Rotation of the eccentric 82 by its operating arm 86 angularly adjusts the gear 69 relative to the annular cam 60 to provide secondary adjustment. The eccentric operating arm 86 is pivoted for example by a load responsive actuator 88 like that used for pivoting the spill collar operating arm in U.S. Pat. No. 4,376,432 of Charles W. Davis, dated Mar. 15, 1983.

In case (c) above, in the example shown in FIG. 20, the drive gear 69 is angularly adjusted by an electrical stepper motor 214 and the hydraulic actuator 70 is independently operated by a separate electrical stepper motor 214.

Figure 29:
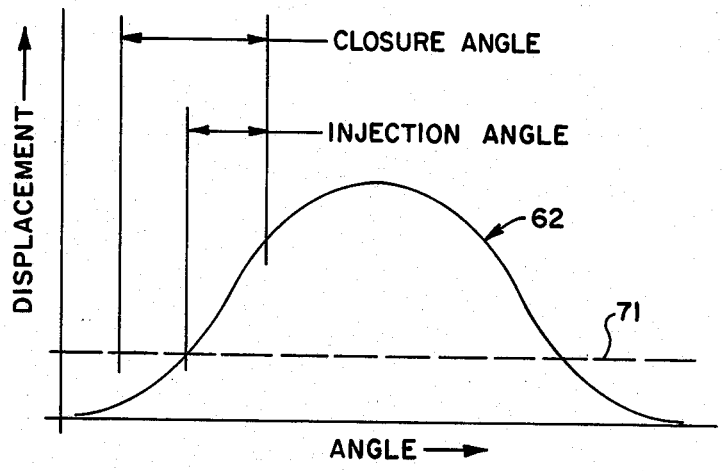
FIG. 29 is a graph illustrating a representative cam profile of an annular cam of the fuel pump and the angles of fuel injection and spill control valve closure.

With the ring gear 69 and cam ring 60 separately angularly adjusted as in the embodiments of FIG. 12 and 20, the dual adjustment can be used to provide both timing and load control. Such dual adjustment provides for selection of the cam lobe segment (and therefore the cam slope and fuel injection rate) that is effective during the fuel injection event. Use of the apex section of the cam lobe 62 (i.e. to provide over the nose fuel injection) can be employed during starting and low engine speed operation, when the reaction force on the cam lobe 62 is less, to provide excess fuel for starting and/or a lower injection rate. As illustrated in FIG. 29 the leading segment of the cam lobe 62 (i.e. the leading segment of the active part of the cam lobe 62 above a base line 71) can also be selected to provide cam ring controlled start-of-injection adjustment and/or gear ring controlled load adjustment. Axial adjustment of the valve member 37 (as hereinafter described) may then be unnecessary or be used only to provide a secondary load or timing control, for example to govern engine speed as hereinafter described.

The present invention can be used with a governor and/or throttle mechanism in addition to or in place of the described adjustment of the cam ring 60 and ring gear 69 for controlling the engine load. Referring to FIGS. 1 and 2, a plurality of governor weights 92 (only two of which are shown in FIG. 1) are equiangularly spaced about the drive shaft 20 and are mounted in a suitable cage 94 attached to the rotor 16 to provide a variable axial bias on an axially shiftable collar 96. The collar 96 comprises a valve operating ring 98 which rotates with the rotor 16 and a non-rotatable sleeve 100 engaging the ring 98. The sleeve 100 engages a pivotal lever 104 to urge the lever 104 in the clockwise direction as viewed in FIG. 1 about its support pivot 106. The lever 104 is biased in the opposite pivotal direction by a governor spring assembly 108, which for example is identical to that disclosed in U.S. Pat. No. 4,142,499 of D. E. Salzgeber, dated Mar. 6, 1979. The opposing bias on the lever 104 provided by the governor spring assembly 108 is established by the angular position of a throttle operated shaft 110 (FIG. 1), and in a conventional manner, the governor spring assembly 108 provides for both idle or minimum speed governing and maximum speed governing.

The valve operating ring 98 has a tang formed to provide an axially offset, radial projection or yoke 112 having a radial slot for receiving a reduced intermediate section of the rotary valve member 37. The valve member 37 is thereby connected t be axially shifted with the collar 96. A suitable circular compression spring is preferably mounted between the yoke 112 and an outer head 118 of the valve member 37 to eliminate any backlash between those parts. The quantity or size of the high pressure charge of fuel delivered by the charge pump 39 in a single inward pumping stroke of the pumping plungers 40 is adjustable by adjusting the axial position of the rotary valve member 37. The opposing forces of the governor spring assembly 108 and governor fly weights 92 control the axial position of the valve member 37 to govern the engine at preestablished idle and maximum speeds. The throttle operated shaft 110 axially positions the valve member 37 throughout the full intermediate speed range of the engine.

The present invention can also be used with a governor spring assembly of the type used for full speed range governing and wherein the throttle operated shaft 110 is used to set the engine speed and the governor mechanism governs the fuel injection pump to maintain the engine speed at that speed setting. For example, a full speed range governor spring assembly may be used like that disclosed in U.S. Pat. No. 2,865,347 of V. D. Roosa, dated Dec. 23, 1958.

The fuel control valve 36 functions as both an inlet valve and a spill valve. In its function as an inlet valve, it provides for connecting the fuel supply ports 35 to the plunge bore 42 during the outward or intake stroke of the plungers 40. Fuel at transfer pump pressure is thereby supplied to the charge pump 39 preferably without restriction or inlet metering. The centrifugal force of the plungers 40 and the unrestricted fuel supply provides for fully charging the charge pump without cavitation and with the same full charge during each outward intake stroke of the pumping plungers 40.

The fuel control valve 36 can provide spill control or spill timing at both the beginning and end or at only the beginning or end of the fuel injection event. In the embodiments shown in FIGS. 1, 2 and 27, spill control can be provided during both intervals, and the spilled fuel is returned to an accumulator chamber 120 at the inner end of the radial bore 29 in the housing 12. An accumulator piston 122 is mounted in the radial bore 29 and is biased to its inner limit position shown in FIG. 1 by a compression spring 124 having a preload established by an externally threaded, adjustable spring seat 126. A snap ring is mounted within an external annulus in the accumulator piston 122 to establish the inner limit position of the piston.

In the embodiment shown in FIG. 2, an outer generally cylindrical surface of the accumulator piston is provided with a helical groove 130 extending from the outer end of the piston 122 to an intermediate discharge port 132 connected to the pump housing cavity via a circular groove or annulus 134 in the housing 12 aligned with the valve member 37. The accumulator piston 122 is thereby cooled by a continuous flow of fuel helically around the accumulator piston. A suitable flow restrictor 136 is placed in the outlet passage connecting the discharge port 132 to the housing annulus 134 to regulate the rate of flow of fuel used for cooling.

In the embodiment shown in FIG. 2, the accumulator piston 122 has an inner axial bore, an outer axial bore providing a spring chamber for the accumulator spring 124 and an intermediate ball check valve 30 with a central valve port. A snap ring is mounted within the inner axial bore to retain the valve ball 142 adjacent its conical valve seat for quickly closing the check valve 30 when fuel is returned to the accumulator chamber 120.

In the embodiment shown in FIG. 27, the accumulator piston 122 has a peripheral annulus 127, diametral bore 129 and inner axial bore for delivering fuel via the ball check valve 30 to the charge pump 39. The discharge port 132 is located so that it is closed by the accumulator piston 122 when it is at its inward limit position. The accumulator piston 122 serves as a bypass valve which when displaced slightly outwardly, opens the discharge port 132 to permit bypass fuel flow from the transfer pump to minimize any enertia caused reduction of fuel flow to the charge pump 30 during the next fuel intake stroke of the pumping plungers 40. Also, a second discharge port 133 is opened after the port 132 to limit the amount of fuel accumulated in the accumulator chamber 120. Discharge port 132 is connected via a suitable restriction 136 to return fuel to the housing cavity.

The fuel accumulated during each inward or pumping stroke of the plungers 40 is redelivered to the charge pump 39 during the next intake stroke of the pumping plungers 40. The accumulator spring 124 is preferably preloaded to establish an accumulator pressure of for example approximately 200–300 psi which is significantly above the 40–100 psi transfer pressure range and significantly below the fuel injection pressure of up to 12,000 psi or more. During each intake stroke of the pumping plungers 40, the high accumulator pressure accelerates the fuel charging step to ensure complete fuel charging even at high pump speed.

Figure 28:
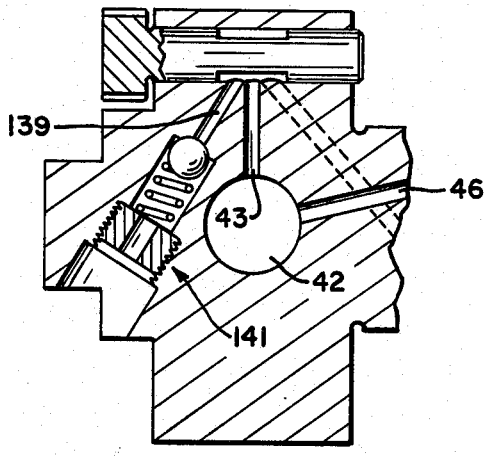

In the embodiment of the spill control mechanism shown in FIG. 28, a separate spill discharge passage 139 is provided in the rotor body 18 for returning the spilled fuel to the housing cavity. A one-way ball check valve 141 is provided in the spill discharge passage 139. That discharge check valve 41 and the inlet ball check valve 30 provide one way fuel flow to and from the rotary control valve 36.

Referring to FIGS. 2 and 4–7, the valve member 37 has a pair of identical diametrically opposed lands 150 for simultaneously opening and closing the two diametrically opposed valve ports 35. The radial connecting bore 43 preferably has a valve port which has a circumferential width greater than the maximum width of the lands 150 so that fuel is supplied without interruption to the charge pump 39 during the outward or intake stroke of the plungers 40 while the valve ports 35 are open. The two diametrically opposed lands 150 have diametrically opposed leading edges 152 for simultaneously closing the valve ports 35 and diametrically opposed trailing edges 154 for simultaneously opening the valve ports 35. In FIGS. 4–7, the circumferential width of the valve lands 150 varies along the axis of the valve member 37 so that the closed angular interval is dependent upon the axial position of the valve member 37. In the embodiment shown in FIG. 4, the leading and trailing edges 152, 154 taper toward each other in the retard and advance angular directions respectively. Alternatively, the leading edge 152 may be parallel to the axis of the valve member 37 as shown in FIG. 7, or (a) inclined in the advance direction as shown in FIG. 6 (to advance the fuel injection timing with load) or (b) inclined in the retard direction as shown in FIG. 5 (to retard the fuel injection timing with load). Likewise, the trailing edge 154 could be (a) inclined in the retard direction as shown in FIG. 5 or (b) inclined in the advance direction as shown in FIG. 6 as may be found desirable for any particular application. In each FIGS. 4–7, the leading and trailing edges 152, 154 are related to provide a land 150 of decreasing circumferential width to decrease the closed angular interval as the valve member 37 is axially shifted to the left as viewed in FIG. 1. Also, the land segment which is effective at the fully retracted engine cranking position of the valve member is preferably enlarged to provide excess fuel for starting. In the alternative, when load control is provided by angular adjustment of the cam ring 60 and ring gear 69, the lands 150 have a constant width. In that event, the parallel leading and trailing edges may be inclined to the valve axis to provide timing control by axial adjustment of the valve member 37.

Thus, the size of the injected fuel charge and/or the timing of the beginning and/or end of the fuel injection event can be spill controlled in accordance with the axial position of the valve member 37. In addition, the fuel injection timing can be controlled by angular adjustment of the ring gear 69 and/or cam ring 60. Where the ring gear 69 and cam ring 60 are axially adjusted together, the same segments of the cam lobes 62 are employed for the fuel injection event throughout the full load range of the engine and the rate of injection is established by the slope of those cam segments. If the cam ring 60 and ring gear 69 are relatively angularly adjustable, then the effective cam lobe segment can be shifted. In both cases, the shape of the cam lobes is optimized for the described spill control. The cam lobe shape and timing adjustment range are related so that during pump operation above idle speed, the fuel injection event is spill terminated before the pumping plunger actuating rollers 64 reach the apex or nose segment of the cam lobe 62 where the contact pressure on the cam lobe 62 would be the greatest. As a result, a fuel injection pressure of up to 12,000 psi or more can be delivered by the pump without creating an unacceptably high contact pressure on the cam lobes 62. Over the nose fuel injection can be employed during engine cranking and/or low engine speed (when the reaction force on the cam lobe 62 is relatively low due to the low pump speed) to provide excess fuel for starting and/or to decrease the fuel injection rate to produce more quiet combustion.

The valve ports 35 are closed twice during each revolution of the valve member 37. If the valve drive gearing 67, 69 provides for rotating the valve member 37 exactly four full revolutions for each revolution of the rotor 16, then the fuel control valve 36 is capable of providing a fuel injection event every 45 degrees of rotation of the rotor 16. Thus, the same gearing can be employed to provide either two, four or eight fuel injection events during one full revolution of the rotor 16 (and therefore two revolutions of the associated engine) depending on the number of pairs of diametrically opposed cam lobes provided on the cam ring 60. Similarly, gearing designed for rotating the valve member 37 exactly three full revolutions for each full revolution of the rotor 16 can be used to provide either three or six fuel injection events during one full revolution of the rotor 16. Also, gearing providing exactly two and one-half revolutions of the valve member 37 for every full revolution of the rotor 16 can be used to provide five fuel injection events per pump revolution (i.e. for a five cylinder engine and for example using a pumping plunger and plunger operating cam arrangement as disclosed in U.S. Pat. No. 4,255,097 of Charles W. Davis et al, dated Mar. 10, 1981). Thus, the same basic pump design can be generally universally employed with minimum customization of parts for each engine application.

In view of the substantially higher rate of rotation of the valve member 37 than the rotor 16, the rotary valve 36 is quickly closed and opened to provide very precise spill control of the beginning and/or end of the fuel injection interval. Accordingly, the rotating valve member 37 reduces the undesirable fuel restriction interval during port opening and closure and the undesirable fuel leakage interval just before the port opens.

The relatively small "dead" volume within the rotor 16 minimizes the effect of fuel compression on the size and timing of the fuel injection event. The valve member 37 is hydraulically balanced throughout its entire operating cycle to maximize valve reliability and minimize valve wear and the forces required for rotating and axially shifting the valve member 37. Since the periphery of the rotor body stem 25 does not provide spill valving as in conventional spill control systems exemplified by the system disclosed in U.S. Pat. No. 4,376,432, the diameter of the rotor body stem 25 and the cost of manufacture of the related pump structure can be reduced.

Figure 10:
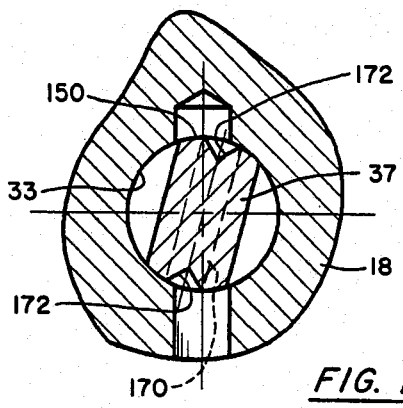
FIG. 10 is an enlarged partial transverse section view, partly broken away and partly in section, of the modified rotor shown in FIGS. 8 and 9.
Figure 21:
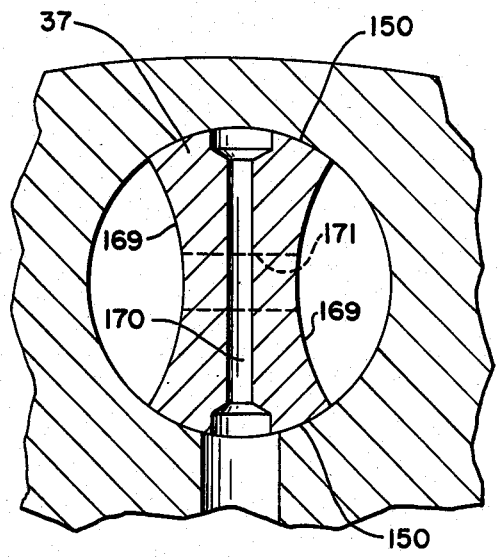
FIGS. 21–23 are enlarged partial transverse section views, partly broken away and partly in section, of modified fuel control valves of the spill control mechanism.

A modified rotor shown in FIGS. 8–10 has two intersecting diametral bores 42 and four equiangularly spaced pumping plungers 40. A single bore 162 is provided in the rotor body to connect the external groove 32 to the valve bore 33. That connecting bore 162 is offset from the valve bore 33 to provide a connecting port 164 having a circumferential dimension greater than the maximum circumferential width of the valving member lands 150 to preclude interruption of fuel flow to the charge pump during the outward intake stroke of the pumping plungers 40. The valve member 37 opens and closes a single valve port 166 of a radial bore 168 connecting the valve bore 33 to the central intersection of the two pumping plunger bores 42. The "dead" volume of the high pressure fuel cavity of the rotor is thereby reduced. The connecting bore 168 crosses the valve bore 33 and the valve member 37 is formed with a diametral bore 170 and connecting axial channels or grooves 172 in its two diametrically opposed lands 150 to balance the hydraulic side forces on the valve member 37 without effecting the valve spill control. In a modified valve member 37 shown in FIG. 21, the ends of diametral bore 170 are enlarged to hydraulically balance the valve member. Also, the recessed portions 169 of the valve member 37 are concave to reduce the hydraulic impact torque on the valve member 37 during return spill flow to the control valve 36. In addition, a second diametral bore 171 (offset from bore 170) is provided in the valve member 37 between the recessed portions 169 to facilitate intake fuel flow to the pumping chamber.

Where, as in the embodiment of FIG. 8, a single valve port 35 provided by the radial bore 43 is employed for opening and closing the control valve 36, one of the two opposed valve lands 150 may not be used, depending on the number of valve member revolutions and injection events provided during each revolution of the rotor 16, in which event the unused land may be shortened or otherwise configured so as not to close the single valve port.

Figure 24:
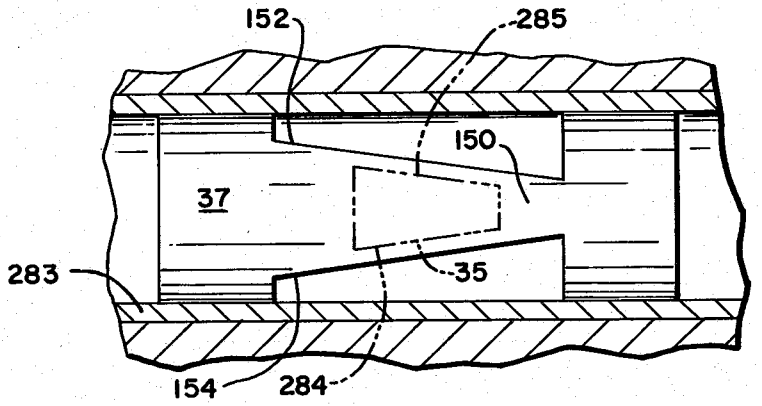
FIGS. 24 and 25 are enlarged partial longitudinal section views, partly broken away and partly in section, showing modified spill port configurations employed in the fuel control valves of FIGS. 22 and 23.
Figure 25:
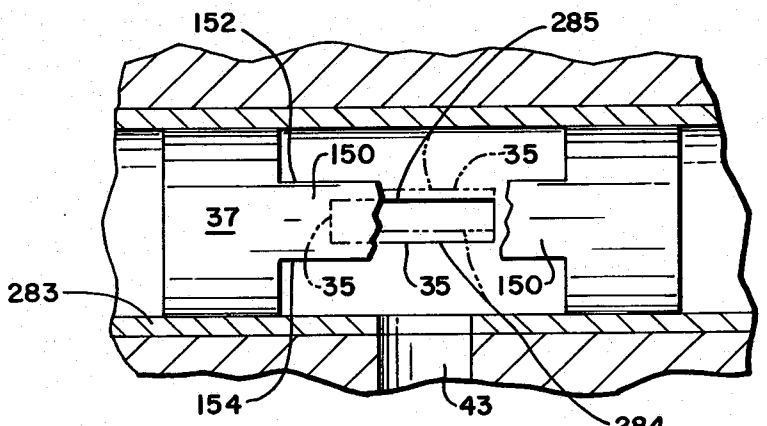
Figure 22:
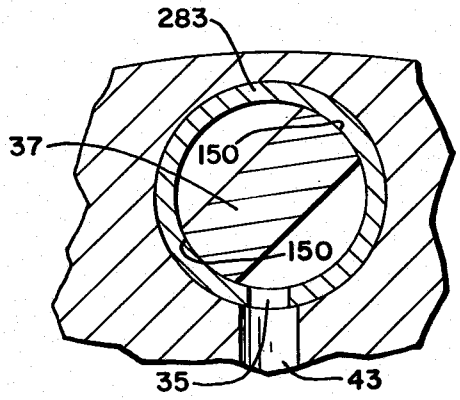
Figure 23:
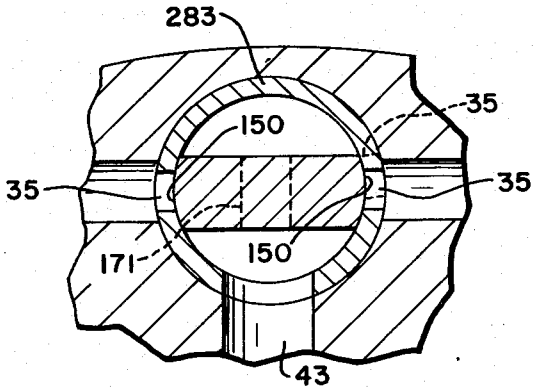
Figure 26:
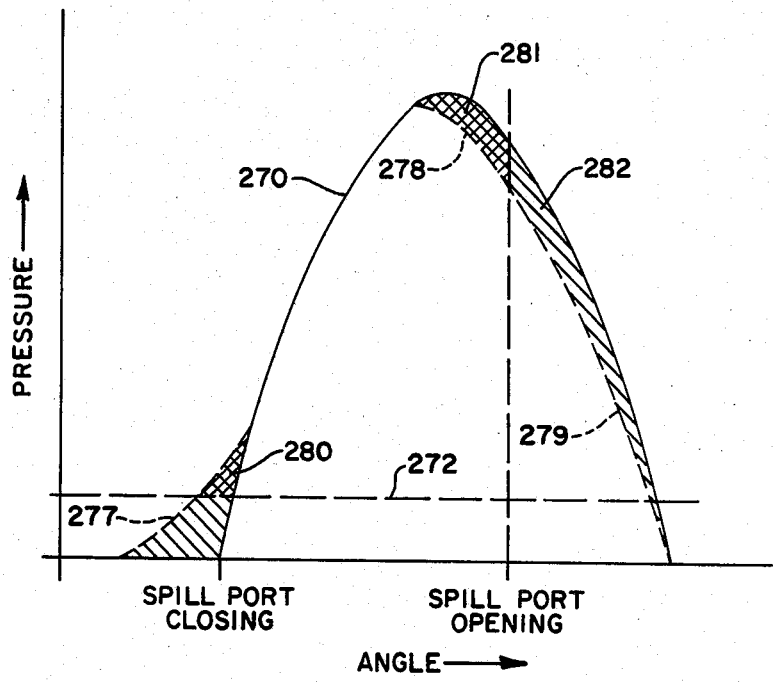
FIG. 26 is a graph illustrating the effect of spill port restriction and leakage on the shape of a fuel injection event pressure pulse.

Referring to FIG. 26, the solid line curve 270 represents a pressure curve of an exemplary fuel injection event without fuel restriction during port closure or fuel leakage before port opening. The base line 272 represents the pressure at which the fuel injection nozzle (not shown) opens to begin injection. The broken line 277 represents the pressure variation caused by fuel restriction during port closure, the broken line 278 represents the pressure variation caused by fuel leakage before port opening and the broken line 279 represents the pressure variation caused by fuel restriction during port opening. The shaded areas 280–282 represent the variations in the fuel injection event caused by fuel restriction and fuel leakage. Both of those effects are substantially reduced by the rotation of the control valve 36 at a higher speed than the rotor 16. In addition, the spill valve ports can be configured and/or offset to further reduce such effects, for example as shown in FIGS. 22–25, wherein the valve ports 35 are shown provided by a valve sleeve 283. In FIGS. 22 and 24, a single spill port 35 is provided having a trapezoidal shape for more quickly opening and closing the spill valve 36. In FIGS. 23 and 25, a pair of diametrically opposed rectangular spill ports 35 are employed to more quickly open and close the spill valve 36. Also, in FIGS. 23 and 25, one of the two spill ports 35 is shown in broken lines slightly angularly offset so that one port 35 opens slightly before the other port 35 to adjust the effect of fuel leakage and fuel restriction. In all of the embodiments shown in FIGS. 22–25, the leading and trailing edges 284, 285 of the generally rectangular ports 35 are parallel to the trailing and leading edges 154, 152 respectively of the valve member 37.

Figure 13:
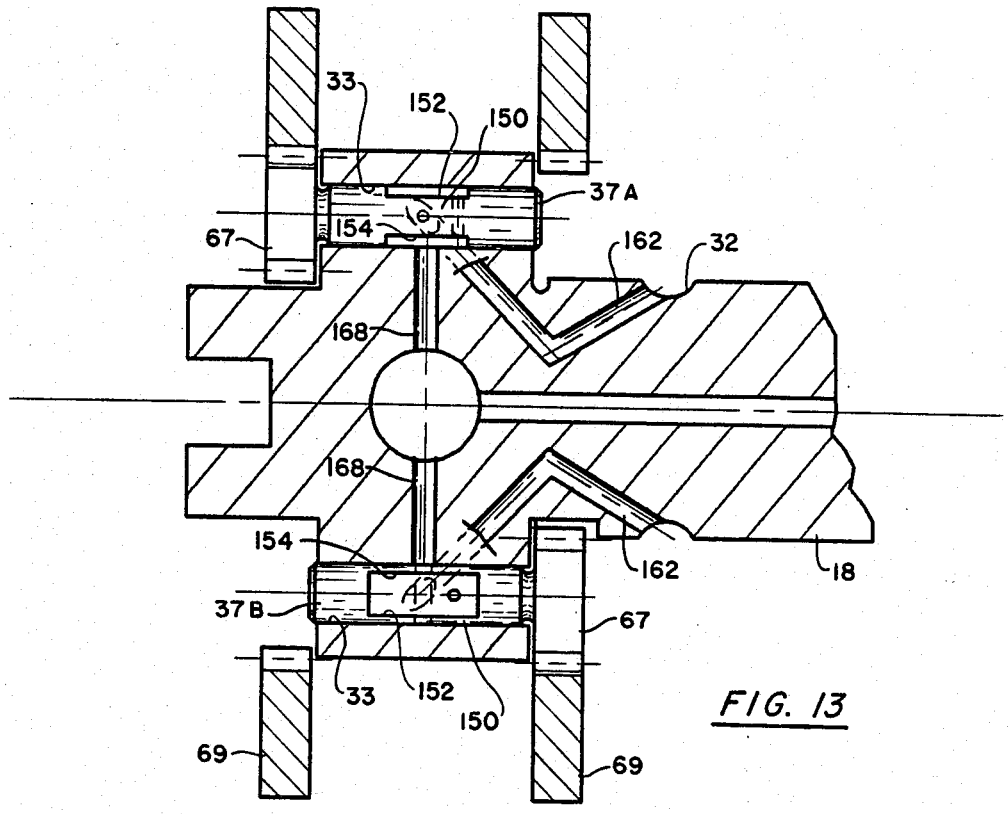
FIGS. 13–16 and 28 are enlarged partial longitudinal section views, partly broken away and partly in section, showing further modified embodiments of the spill control mechanism.

A modified rotor shown in FIG. 13 has two axial valve bores 33 and two corresponding preferably identical valve members 37A, 37B connected in parallel between the external groove 32 and two separate radial bores 168 leading to the pumping plunger bore(s). One of the valve members 37A is used for beginning of injection spill control and the other valve member 37B is used for end of injection spill control. The two valve members 37A, 37B are rotated by two separate ring gears 69 to provide separate and independent angular adjustment of the two valve members and therefore separate and independent spill control of the beginning and end of the fuel injection event. Separate angular adjustment of the cam ring 60 can be provided as previously described. If the valve member 37A or 37B is axially adjusted, the leading and trailing edges 152, 154 of that valve member preferably are parallel to the axis of the valve member. One or both of the valve members could be axially adjusted as previously described and the diametrically opposed lands 150 of each such axially adjusted valve member could be formed accordingly to provide the desired spill control. The two ring gears 69 are shown mounted at opposite axial ends of the control valves but may be mounted at the same axial end. The two gear rings 69 are independently angularly adjusted by separate linear actuators.

Figure 14:
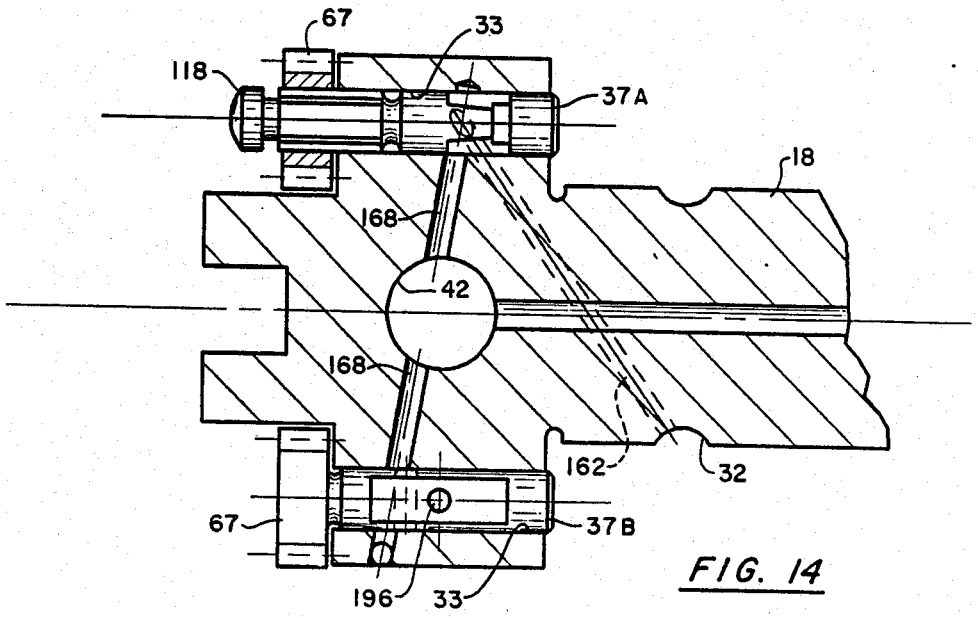
Figure 15:
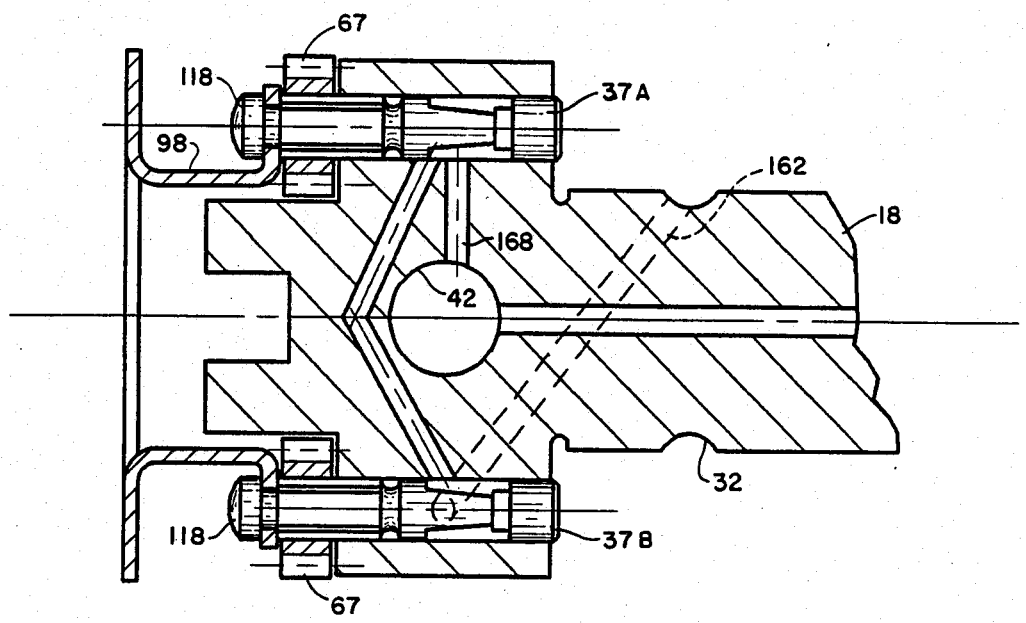
Figure 16:
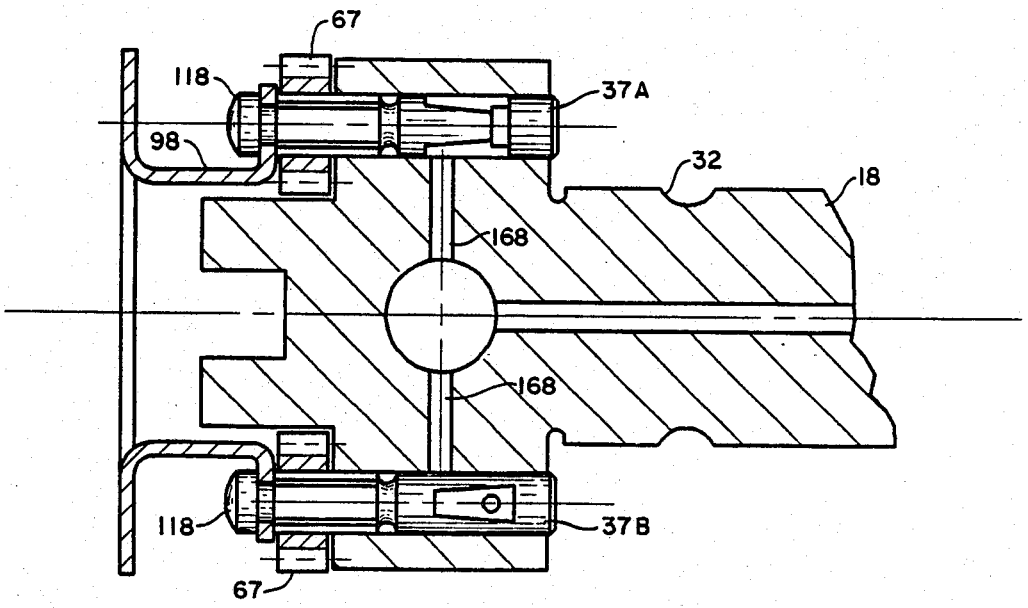

Three additional modified rotors shown in FIGS. 14–16 employ two fuel control valves 37A, 37B in the manner of the modified rotor 180 shown in FIG. 13 but for a different purpose. In FIGS. 14–16, the two valve members 37A, 37B provide for a two phase fuel injection event having a first high pressure pilot injection phase and an immediately succeeding main fuel injection phase. In FIG. 14, a primary valve member 37A functions in the same manner as the valve member 37 employed in the embodiment shown in FIGS. 1–3. A secondary or pilot fuel valve member 37B provides for momentarily relieving the high fuel injection pressure to provide separate pilot and main fuel injection phases. Both valve members 37A, 37B are rotated in synchronism by the same ring gear 69. Also, either both valve members, or as shown only the primary valve member 37A, is axially adjusted. The high pressure is momentarily relieved, for example from 12,000 psi to 5,000 psi by momentarily connecting the charge pump 39 to an additional "dead" volume formed by recesses in the pilot control valve 37B. The pilot valve member 37B has a pair of intersecting diametral bores 196 for momentarily connecting the charge pump to that additional "dead" volume. The diametral bore 196 slightly overlaps the respective connecting bore 168 to provide a very short interval during which the high pressure is relieved. During the outward or inlet stroke of the pumping plungers 40, the additional "dead" volume is connected to the inlet or transfer pressure to relieve the "dead" volume pressure for the succeeding fuel injection event. The size of the "dead" volume is established to achieve the desired momentary pressure reduction by compression of the fuel in the additional "dead" volume. If needed, additional "dead" volume can be provided in the rotor body 18 in communication with the pilot valve bore 33. Alternatively, a suitable small volume spring biased accumulator piston (not shown) may be mounted in the rotor body 18 in communication with the pilot valve bore 33 to momentarily reduce the fuel injection pressure.

In the rotor embodiment shown in FIG. 15, the two fuel control valves 37A, 37B are connected in series for series spill control. The primary spill control valve 37A provides spill control of the beginning and end of the main fuel injection phase and the secondary or pilot fuel control valve 37B provides spill control of the beginning and end of the pilot injection phase. Both fuel control valves 37A, 37B are axially adjusted.

Figure 17:
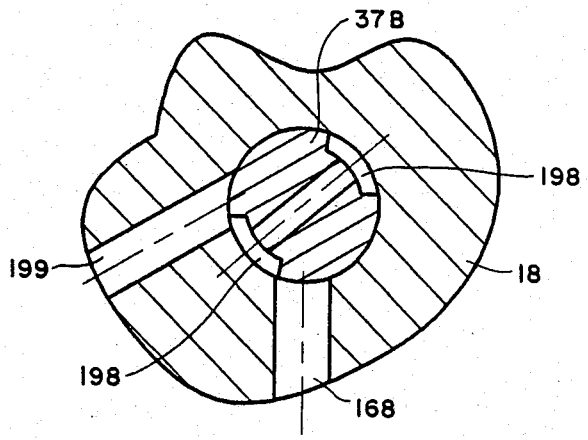
FIG. 17 is an enlarged partial transverse section view, partly broken away and partly in section, of a secondary fuel control valve of the spill control mechanism of FIG. 16.

The rotor embodiment shown in FIG. 16 is similar to that shown in FIG. 15 except that in FIG. 16 the primary and secondary fuel control valves 37A, 37B are mounted in parallel as in FIG. 13 rather than in series as in FIG. 15. The primary valve member 37A provides spill control of the beginning and end of the entire fuel injection event. The secondary or pilot valve member 37B provides for momentarily relieving the high pressure for separating the fuel injection event into separate pilot and main fuel injection phases. For that purpose, the pilot valve member 37B momentarily connects the charge pump to the housing cavity via one of two diametrically opposed peripheral grooves 198 in the valve member 37B and via a bore 199 in the rotor body 18 as shown in FIG. 17.

Figure 18:
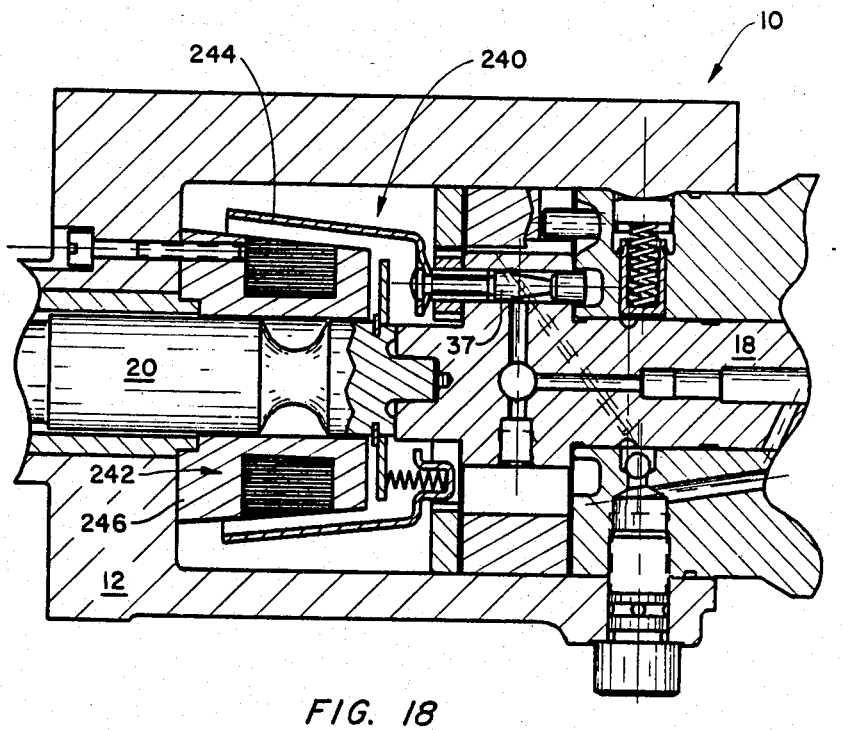
FIGS. 18 and 19 are enlarged partial longitudinal section views, partly broken away and partly in section, showing further modified embodiments of the spill control mechanism of the present invention having solenoid and stepper motor operating systems respectively.
Figure 19:
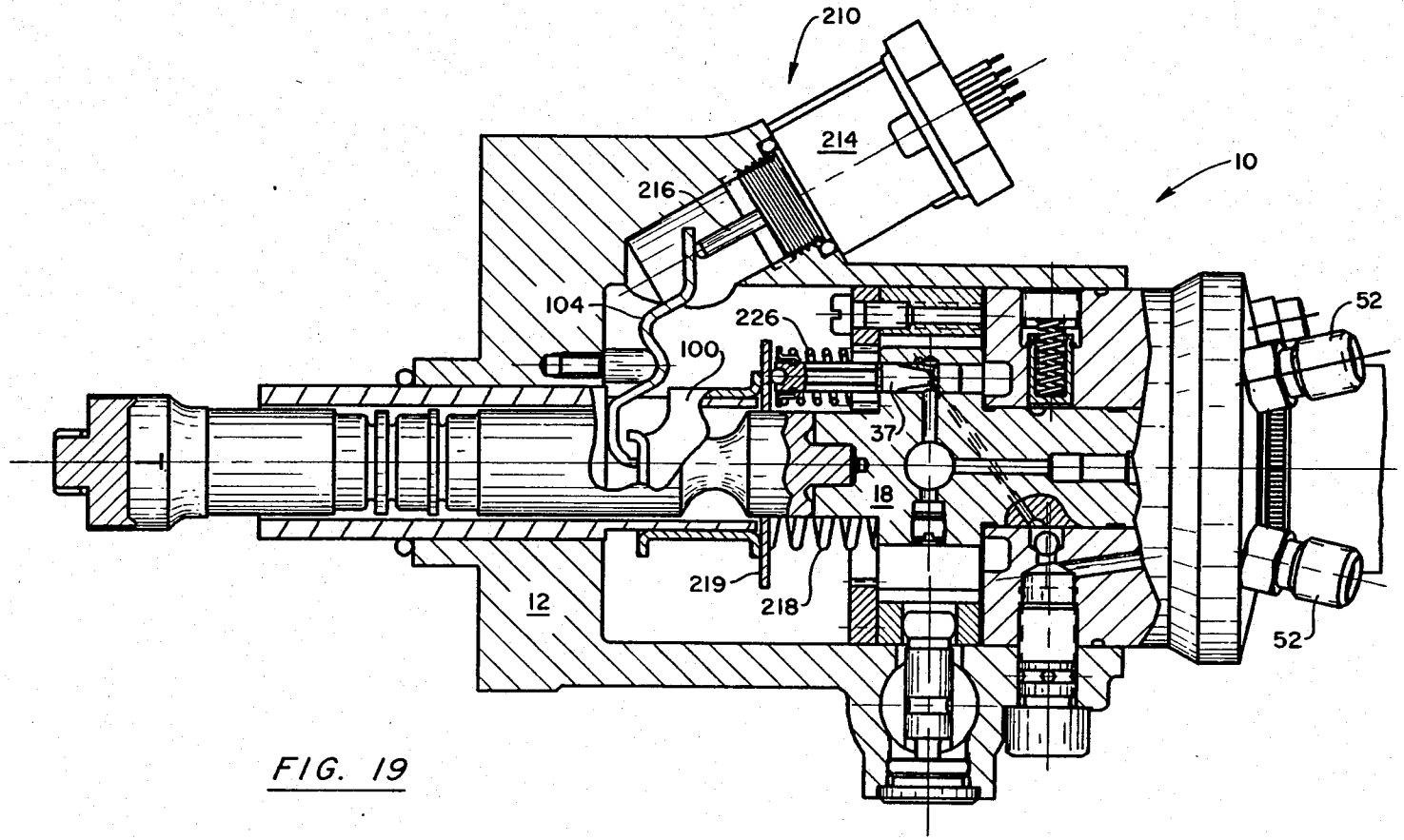

FIGS. 18 and 19 show two alternative mechanisms 210, 240 for axially positioning the fuel control valve member(s) 37. In FIG. 19, a bidirectional rotary stepper motor 214 having a linear actuating pin 216 is provided for axially positioning the valve member(s) via the lever 104 and sleeve 100. The sleeve 100 is biased in the opposite axial direction by a compression spring 218 mounted between the rotor body 18 and a thrust plate 219. The valve member(s) 37 are axially positioned by the thrust plate 219. For that purpose, a ball bearing 222 is mounted within a pocket in the outer end of the valve member 37 and the valve member 37 is biased outwardly by a compression spring 226 to urge the ball bearing into engagement with the thrust plate 219. A linear fuel quantity feedback sensor (not shown) is mounted within the pump housing 12 with its linear plunger engaging the thrust plate 219. The sensor supplies a signal to an electronic control unit (not shown) to complete a fuel quantity control loop.

In FIG. 18 the valve member(s) 37 are positioned by a solenoid 242 having an annular armature 244 coaxially mounted for rotation with the rotor 18 and connected to the valve member(s) 37. The armature 244 is axially shiftable by a fixed annular electromagnet 246 which encircles the rotor drive shaft 20. Therefore, the axial position of each valve member 37 is dependent upon the voltage applied to the electromagnet 246.

The several described embodiments of the spill control mechanism of the present invention can be used with a min/max or full speed range governor or with an electrical control as described. Also, it will be apparent that the different features illustrated in connection with the several embodiments of the invention disclosed herein may be utilized and incorporated in other embodiments as desired. As will be apparent to persons skilled in the art, various modifications, adaptations and variations of the foregoing specific disclosures can be made without departing from the teachings of the present invention.

I claim:

1. In a rotary fuel injection pump for an internal combustion engine, having a housing, a rotor rotatable in the housing, a charge pump having a plurality of radially extending plunger bores in the rotor and a plunger pump for each plunger bore having a pumping plunger reciprocable in the bore, the pumping plungers having outward fuel intake strokes and inward fuel delivery strokes for supplying high pressure charges of fuel for fuel injection, a cam ring surrounding the rotor and engageable with the plunger pumps to reciprocate the plungers as the rotor rotates, and pumping plunger timing means for relatively angularly adjusting the cam ring and rotor for adjusting the pumping plunger timing, and a spill control mechanism having spill valve means connected to the charge pump for spill control of the said high pressure charges of fuel, the improvement wherein the spill valve means comprises at least one rotary spill valve having a valve bore in the rotor connected to the charge pump and a rotary spill valve member rotatably mounted within the valve bore, and wherein the spill control mechanism comprises first means for rotating each rotary spill valve member in unison with the rotor and in synchronism with the reciprocable movement of the pumping plungers for spill control of the said high pressure charges of fuel, the pumping plunger timing means and said first means providing for separate relative angular adjustment of the cam ring and rotor and relative angular adjustment of the rotary spill valve member of at least said one rotary spill valve and the rotor.

2. A fuel injection pump according to claim 1 wherein each rotary spill valve has a valve bore in the rotor radially spaced from and generally parallel to the axis of the rotor.

3. A fuel injection pump according to claim 1 or 2 wherein said first means comprises drive gear means and gear means on each rotary spill valve member engageable with the drive gear means to rotate the valve member within its valve bore in unison with the rotor.

4. A fuel injection pump according to claim 3 wherein said first means comprises angular adjustment means for angular adjustment of the drive gear means.

5. A fuel injection pump according to claim 1 wherein the rotary spill valve member of at least said one rotary spill valve is mounted for axial adjustment within its valve bore for adjusting its spill control of the said high pressure charges of fuel and wherein the spill control mechanism comprises second means for axially adjusting each such axially adjustable valve member.

6. A fuel injection pump according to claim 1 wherein said one spill valve comprises at least one valving port and the rotary spill valve member of said one spill valve comprises at least one corresponding valving land for the valving port, each said valving port having respective leading and trailing edges generally parallel t the trailing and leading edges respectively of the corresponding valving land

7. A fuel injection pump according to claim 1 wherein the spill valve means comprises a high pressure bore in the rotor connecting the charge pump to said one rotary spill valve and intersecting the valve bore thereof to form a valve port thereto, and wherein the rotary spill valve member of said one rotary spill valve has a generally diametral bore aligned with said valve port to balance the hydraulic side forces on the rotary spill valve member during the supply of each said high pressure charge of fuel.

8. A fuel injection pump according to claim 1 wherein said one spill valve comprises a pair of generally diametrically opposed valving ports, and wherein the rotary spill valve member of said one spill valve comprises a pair of diametrically opposed valving lands for generally simultaneously opening and closing said valving ports, the leading and trailing edges of each valving port being generally parallel to the trailing and leading edges respectively of each valving land.

9. A fuel injection pump according to claim 8, wherein the pair of opposed valving ports are slightly relatively angularly offset to commence opening and closing the ports in sequence.

10. A fuel injection pump according to claim 1 further comprising a fuel transfer pump, a fuel line for conducting fuel from the transfer pump to said one rotary spill valve to supply fuel to the charge pump during the intake strokes of the pumping plungers, a bypass valve having a bypass valve bore connected to said one rotary spill valve, a bypass piston mounted in the bypass valve bore, spring means biasing the bypass valve piston in one axial direction thereof to a closed position thereof, the piston being displaceable in the opposite axial direction thereof from its closed position against the bias of the spring means by fuel spilled from the charge pump to one end of the bypass valve bore, the bypass valve having a bypass passage connected for bypassing fuel from the fuel line when the bypass valve piston is displaced from its closed position.

11. A fuel injection pump according to claim 10 wherein the bypass valve piston has a one-way check valve for supplying fuel through the piston to the charge pump during the intake strokes of the pumping plungers.

12. A fuel injection pump according to claim 1 wherein said one rotary spill valve has a discharge port for discharging spilled fuel and further comprising a one-way check valve connected to said discharge port for one way spill discharge through the discharge port.

13. A fuel injection pump according to claim 1 wherein the rotary spill valve member of at least said one rotary spill valve has at least one peripheral valving land for intermittently opening and closing the rotary spill valve as the spill valve member rotates.

14. A fuel injection pump according to claim 13 wherein each said valving land extends axially and has leading and trailing spill control edges, wherein the rotary spill valve member of at least said one rotary spill valve is mounted for axial adjustment within its valve bore and wherein the spill control mechanism comprises second means for axially adjusting each such axially adjustable valve member.

15. A fuel injection pump according to claim 14 wherein the leading and trailing spill control edges of each valving land are non-parallel.

16. A rotary fuel injection pump according to claim 1 wherein the axis of at least said one rotary spill valve is parallel to the axis of the rotor.

* * * * *